US006413469B1

(12) United States Patent
Stomp et al.

(10) Patent No.: US 6,413,469 B1
(45) Date of Patent: Jul. 2, 2002

(54) METHOD AND INSTALLATION FOR LADLE TREATMENT OF STEEL

(75) Inventors: Hubert Stomp, Luxembourg Howald; Albert Feitler, Strassen, both of (LU); Jean-Luc Roth, Hettange-Grande (FR)

(73) Assignee: Paul Wurth, S.A., Luxembourg (LU)

( * ) Notice: Subject to any disclaimer, the term of this patent is extended or adjusted under 35 U.S.C. 154(b) by 0 days.

(21) Appl. No.: 09/341,636

(22) PCT Filed: Jan. 7, 1998

(86) PCT No.: PCT/EP98/00044

§ 371 (c)(1),
(2), (4) Date: Feb. 14, 2000

(87) PCT Pub. No.: WO98/31841

PCT Pub. Date: Jul. 23, 1998

(30) Foreign Application Priority Data

Jan. 15, 1997 (LU) ..... 90005

(51) Int. Cl.[7] ..... C21B 13/00
(52) U.S. Cl. ..... 266/44; 266/210; 266/216
(58) Field of Search ..... 266/202, 204, 266/208, 209, 210, 44, 216

(56) References Cited

U.S. PATENT DOCUMENTS

| | | | | | |
|---|---|---|---|---|---|
| 1,942,202 | A | * | 1/1934 | Cohn | 266/216 |
| 3,618,924 | A | * | 11/1971 | Messing | 266/208 |
| 4,170,344 | A | * | 10/1979 | Megerle et al. | 266/204 |
| 4,496,393 | A | * | 1/1985 | Lustenberger | 266/216 |
| 4,518,422 | A | * | 5/1985 | Metz | 75/58 |
| 4,618,427 | A | * | 10/1986 | Venas | 210/629 |
| 5,413,315 | A | * | 5/1995 | Venas et al. | 266/216 |

FOREIGN PATENT DOCUMENTS

| | | | |
|---|---|---|---|
| DE | 1190479 | * | 4/1965 |
| DE | 2 261 138 | | 12/1972 |
| EP | 0 110 809 A1 | | 6/1984 |
| EP | 0 151 434 A1 | | 8/1985 |

* cited by examiner

*Primary Examiner*—Scott Kastler
(74) *Attorney, Agent, or Firm*—Smith, Gambrell & Russell, LLP

(57) ABSTRACT

The invention concerns a method and an installation for minimising the local wear of a bell during a ladle treatment of a liquid metal by rotating the bell about an axis during the treatment of the liquid metal.

5 Claims, 3 Drawing Sheets

METHOD AND INSTALLATION FOR LADLE TREATMENT OF STEEL

The present invention relates to a method and an installation for the treatment of molten metal, particularly of steel in a ladle.

At present, a series of methods exists for the treatment of molten metal, particularly of steel in the ladle, according to which a bell or a tube is plunged into the molten metal contained in a ladle. Such methods of treatment include, inter alia, those known as CAS, CAS-OB, HALT, etc.

In this type of method, the molten metal contained in the ladle is subjected to different treatments in a confined zone, defined by the bell plunging into the molten metal. A bubbling gas is injected under the bell into the molten metal in order to homogenise it during the treatment. Turbulence then occurs at the surface of the molten metal which leads to an increased local wear of the bell over its lower edge.

The objective of the present invention is to propose a method and a device making it possible to minimise the local wear of the bell during the treatment of molten metal in a ladle.

This objective is attained by a method aiming to minimise the local wear of a bell during a treatment of a molten metal in a ladle, characterised in that the bell is rotated about an axis during the treatment of the molten metal.

The fact that the bell is given a rotational movement enables the local wear of the bell to be minimised. In effect, since the bell rotates during the treatment of the molten metal, increased wear at a given place due to turbulence in the molten metal is no longer a source of concern. The bell is in fact worn uniformly over the whole of its perimeter.

Since these bells are costly and since the replacement of worn bells takes a certain amount of time, the present method also enables the running costs of the installation to be reduced.

Such a method is particularly useful when implementing the method for the treatment of molten steel in a ladle described in the European patent EP 0 110 809. In such a method, by which the steel contained in the ladle is heated by the aluminothermic process and by which a certain number of alloying elements are added to the steel, the bell is asymmetrically stressed:

- on a "hot" side, the bell, or more precisely the refractory lining of the lower edge of the bell, is attacked by thermal shocks and by chemical corrosion produced by splashes of metal and slag. The wear is caused mainly by spalling of the refractory lining.
- on the "cold" side, and possibly in intermittent usage when the refractory lining is cooled, the bell is "fattened" by solidification of splashes of metal and/or of slag.

These phenomena of local wear and "fattening" considerably reduce the working life of the bell and thus increase the costs of production by the method involving addition and heating under the bell. The proposed method prolongs the useful life of a refractory bell by minimising the local wear, by reducing the local "fattening" and even by compensating for local wear by a lining produced in situ.

According to a first advantageous mode of execution, the rotational speed of the bell lies between 0.5 and 2 revolutions per minute during the treatment of the molten metal. The rotational speed of the bell may be adapted as a function of the diameter of the bell, as a function of the treatment applied to the molten metal, and/or as a function of the composition and viscosity of the slag covering the molten metal in the ladle. Of course, the ladle may continue to rotate about its axis even when it is withdrawn from the bath after the treatment of the molten metal.

According to another preferred mode of execution, the bell rotates about a vertical axis, roughly perpendicular to the surface of the molten metal or the molten steel.

According to another aspect of the present invention, an installation is also proposed for the implementation of the method, the said installation incorporating a driving device for driving the bell in a rotational movement during the treatment of the molten metal.

BRIEF DESCRIPTION OF THE DRAWINGS

A preferred mode of execution of an installation according to the invention is described with the help of the appended drawings, in which.

Figure 1:
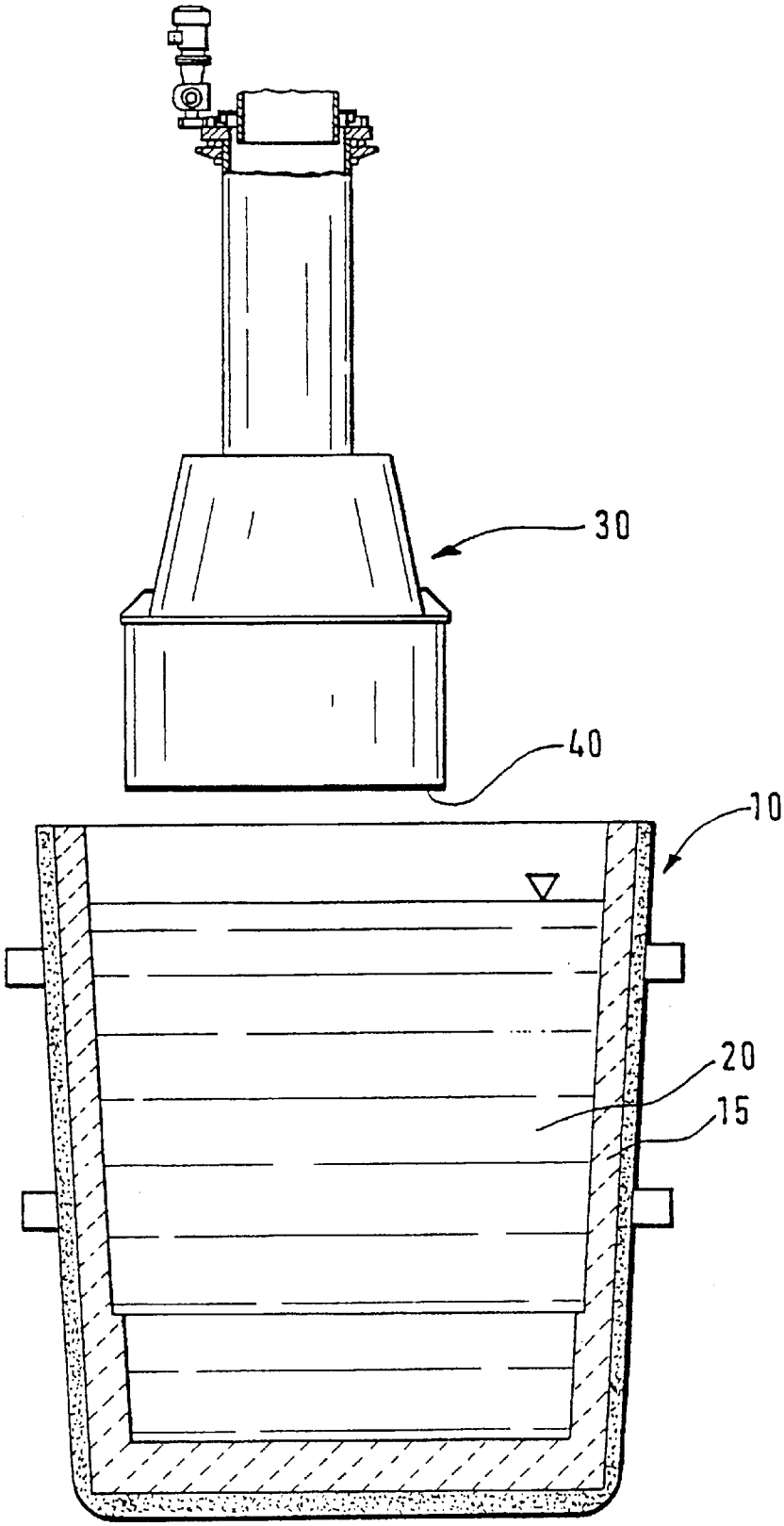
FIG. 1 shows a transverse cross-section through a bell and a ladle filled with molten steel at rest.
Figure 2:
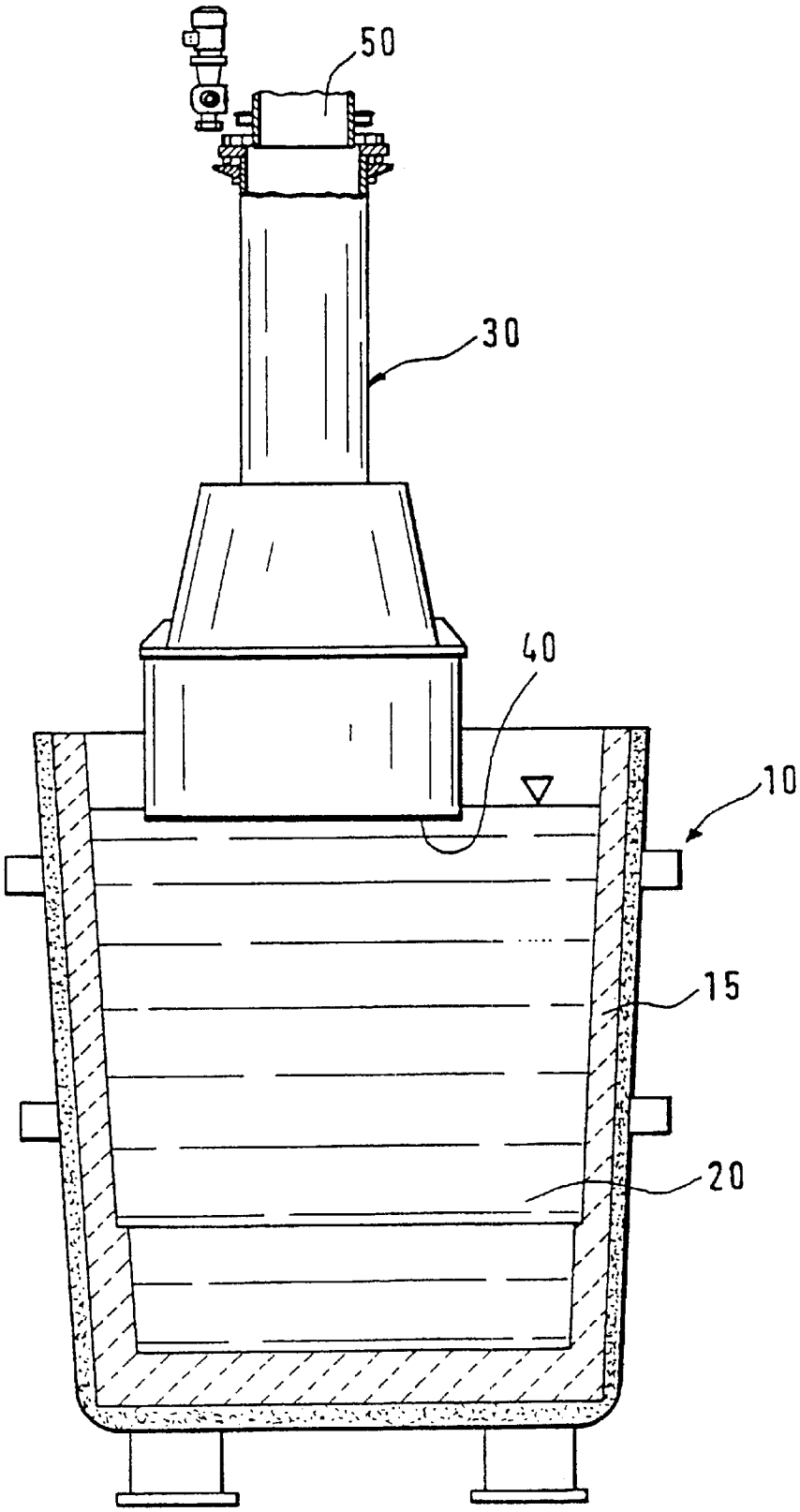
FIG. 2 shows a transverse cross-section through a bell and a ladle filled with molten steel in a working position and FIG. 3 shows an enlargement of a device for driving the bell.

A ladle 10 having a refractory lining 15 is filled with molten steel 20 and is placed below a refractory bell 30. In the working position, during the treatment of the molten metal, the bell 30 is lowered until its lower edge 40 dips into the molten steel 20 (FIG. 2).

The bell 30 is connected to a feed pipe 50 through which the combustible materials and the alloying elements are introduced into the molten steel 20. It comprises a driving device 60 capable of driving the bell in a rotational movement about a vertical axis.

An inert or reducing bubbling gas may be introduced into the molten steel 20 either through a porous plug (not represented) positioned in the bottom of the ladle 10 or through a lance (not represented) which is introduced into the ladle 10. This bubbling gas is used to homogenise the molten steel 20 contained in the ladle 10 during the treatment of the steel 20. This bubbling gas creates turbulence at the surface of the steel 20 which causes a local wear of the bell 30, particularly of the lower edge 40 of the bell 30.

Figure 3:
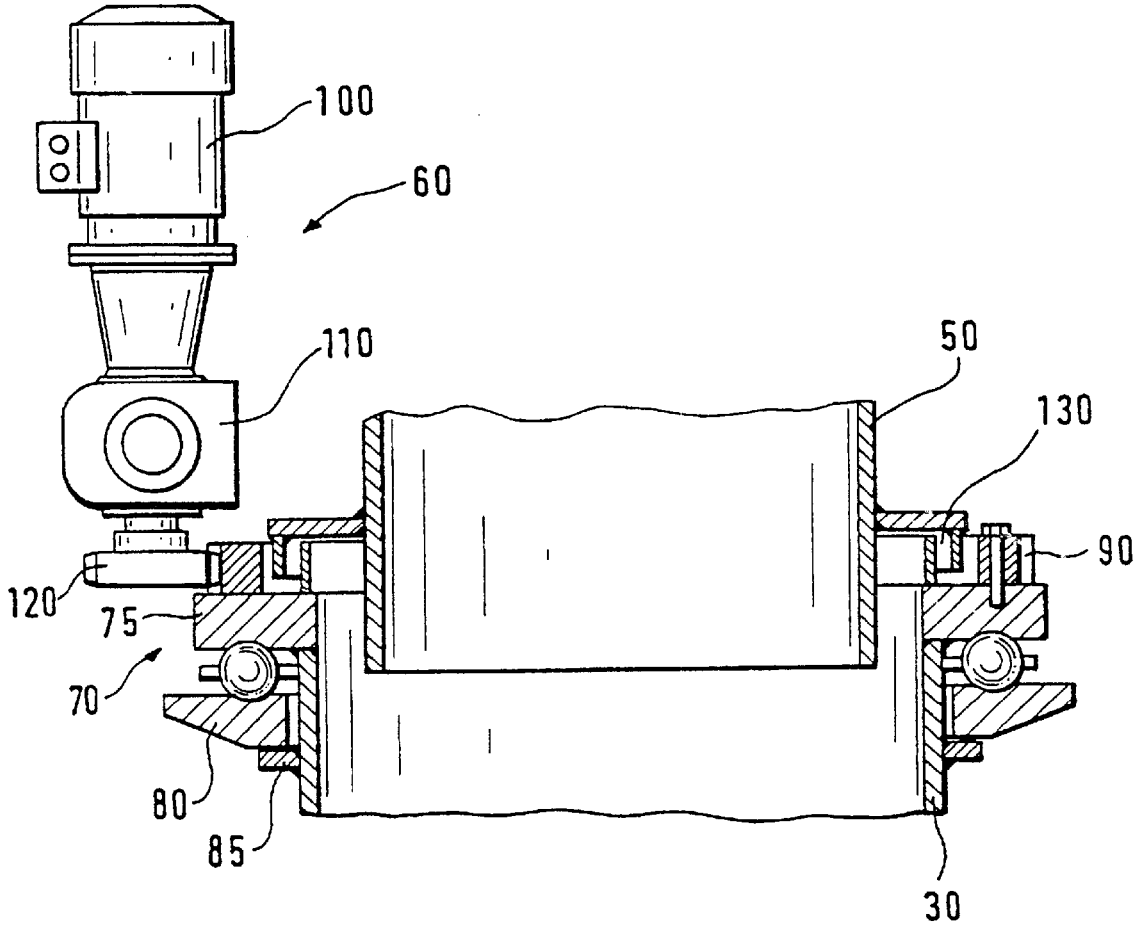

FIG. 3 shows an enlarged view of the device 60 for driving the bell 30. The upper end of the bell 30 carries a ball bearing 70 attached firmly to the bell 30 enabling the bell 30 to execute a rotational movement about its vertical axis. The upper part 75 of the bearing 70 is fixed to the bell 30 while the lower part 85 of the bearing 70 may rotate freely. When the bearing 70 is not under stress, the lower part 80 rests against a stop 85 positioned below the bearing 70. Of course, this bearing 70 must be protected against the influx of impurities.

The bell 30 is held in position by means of a mounting system (not represented) pressing from below on the lower part 80 of the bearing 70 which pushes the bell 30 against the feed pipe 50. The mounting system for the bell 30 may, for example, comprise mounting tongs.

An annular gear 90 is provided on the upper part 75 of the bearing 70. The bell 30 is rotated by means of a motor 100 preferably incorporating a reduction gear 110 enabling the rotational speed of the bell 30 to be varied. The motor 100 drives the annular gear 90 through the intermediary of a gear wheel 120 attached firmly to the motor 100. There are of course other means, well known to one skilled in the art, of imparting a rotational movement to such a bell.

Sealing between the feed pipe 50 and the bell 30 is provided by a baffle 130.

The bell 30 and the feed pipe 50 have an inner lining made of a refractory material. This lining is not shown in the figures so as not to impair the clarity of the drawings.

What is claimed is:

1. A method for minimizing local wear of a bell during the treatment of a molten metal in a ladle comprising lowering the bell and stopping the lowering of the bell when a lower edge of the bell contacts the molten metal and rotating the bell about an axis during the treatment of the molten metal.

2. The method of claim 1, wherein the rotating of the bell is carried out at a rotation rate suited for producing a lining in situ so as to compensate for local wear.

3. The method of claim 1, wherein the bell is rotated at a rotational speed that is between 0.5 and 2 revolutions per minute.

4. The method of claim 1, further comprising introducing an inert gas to homogenize the molten metal whereby the introduced bubbling gas creates turbulence at the surface of the molten metal which turbulence contacts the lower edge of the bell.

5. The method of claim 1, further comprising introducing a reduction gas to homogenize the molten metal whereby the introduced bubbling gas creates turbulence at the surface of the molten metal which turbulence contacts the lower edge of the bell.

* * * * *